US005660046A

United States Patent [19]

de Langavant et al.

[11] Patent Number: 5,660,046

[45] Date of Patent: Aug. 26, 1997

[54] CRYOGENIC TEMPERATURE CONTROL SYSTEM

[75] Inventors: Bernard de Langavant, Outremont; Normand Massé, Beaubarnois; Jean-Jacques de Langavant, Dorion, all of Canada

[73] Assignee: Fridev Refrigeration Systems Inc., Quebec, Canada

[21] Appl. No.: 420,821

[22] Filed: Apr. 12, 1995

[51] Int. Cl.[6] ..... F17C 9/04

[52] U.S. Cl. ..... 62/50.3; 62/239

[58] Field of Search ..... 62/48.1, 50.3, 62/51.1, 239, 50.1–50.2

[56] References Cited

U.S. PATENT DOCUMENTS

| | | | |
|---|---|---|---|
| 2,964,917 | 12/1960 | Webster | 62/50.3 |
| 3,258,931 | 7/1966 | Kelley et al. . | |
| 3,287,925 | 11/1966 | Kane et al. . | |
| 3,385,073 | 5/1968 | Snelling . | |
| 3,525,235 | 8/1970 | Maurer . | |
| 3,803,859 | 4/1974 | Kleffmann et al. . | |
| 3,913,344 | 10/1975 | Holloway et al. . | |
| 4,045,972 | 9/1977 | Tyree, Jr. . | |
| 4,096,707 | 6/1978 | Taylor . | |
| 4,163,369 | 8/1979 | Owen . | |
| 4,186,562 | 2/1980 | Tyree, Jr. . | |
| 4,295,337 | 10/1981 | Johnson et al. . | |
| 4,300,356 | 11/1981 | Notaro et al. | 62/48.1 |
| 4,407,144 | 10/1983 | Garside . | |
| 4,498,306 | 2/1985 | Tyree et al. . | |
| 4,576,010 | 3/1986 | Windecker . | |
| 4,621,500 | 11/1986 | Pagani et al. . | |
| 4,693,737 | 9/1987 | Tyree, Jr. . | |
| 4,695,302 | 9/1987 | Tyree, Jr. . | |
| 4,770,002 | 9/1988 | Viegas et al. . | |
| 4,833,892 | 5/1989 | Wassibauer et al. . | |
| 4,986,086 | 1/1991 | de Langavant . | |
| 5,090,209 | 2/1992 | Martin | 62/50.3 |
| 5,320,167 | 6/1994 | Johnson et al. | 62/239 X |
| 5,337,579 | 8/1994 | Saia, III et al. | 52/239 |

*Primary Examiner*—Christopher Kilner

*Attorney, Agent, or Firm*—Sterne, Kessler, Goldstein & Fox P.L.L.C.

[57] ABSTRACT

Cryogenic cooling system for transport vehicles. The cooling system includes an oversized ceiling evaporator, with adjustable heat absorption capability and pressure regulating mechanism, supplied with liquid $CO_2$ from a main insulated reserve tank through a fill tank which balances the pressure of the liquid $CO_2$ to the proper levels in order to permit the transfer of the refrigerant. To ensure this transfer, a gas-driven pump, activated by the $CO_2$ gas exhaust from the evaporator, circulates the liquid $CO_2$ inside the system. In addition, to ensure a quick stabilization of the temperature of the enclosure, a timed dry-ice injector acts as a booster and safety device to the system.

16 Claims, 10 Drawing Sheets

CRYOGENIC TEMPERATURE CONTROL SYSTEM

FIELD OF THE INVENTION

The present invention relates to the art of controlling the temperature in an insulated enclosure and, more particularly, to a cryogenic cooling system capable of maintaining a comparatively stable temperature within an insulated enclosure. The cooling system is particularly suitable for use on vehicles designed for shipping refrigerated goods.

Truck trailers or railroad vehicles designed for the transport of perishable products rely mostly on mechanical forced convection systems to maintain low temperature conditions in the cargo area. Refrigeration units operating on the principle of forced convection include an evaporator on the front wall of the cargo area, in which flows a refrigerant that converts from liquid to gas in order to absorb thermal energy and thus lower the ambient temperature. A fan mounted behind the evaporator creates a stream of cold air which is intended to establish uniform temperature conditions by continuously circulating air in the cargo area.

By reason of simplicity of installation, mechanical refrigeration by forced air convection has become the standard for transport vehicles. Yet, this approach toward temperature control has some major drawbacks. Perhaps, the most serious shortcomings are the lack of flexibility and the inability to insure uniform temperature conditions. For instance, products that are located in close proximity to the evaporator unit may be overcooled while goods stored away from the evaporator are undercooled. In addition, the forced air circulation maintained in the cargo area has the undesirable effect of depleting moisture at an accelerated rate from the products stored in the cargo area. This is particularly damaging to unpackaged meat and fish products which are very sensitive to desiccation.

In an attempt to overcome the drawbacks associated with mechanical forced convection systems, the industry has developed cryogenic cooling units that absorb thermal energy by causing liquid cryogen such as $CO_2$ to evaporate within the cargo area. In contrast to mechanical unit equipped with compressor, the gaseous cryogen after performing its cooling function is dumped in the atmosphere rather than being re-liquified in order to perform repeated cooling cycles.

Cryogen cooling systems generally fall in two categories. The first is the injection method which is used mostly for pre-cooling a cargo area. Liquid cryogen, kept under pressure, is sprayed directly in the cargo area at atmospheric pressure. Immediately, dry snow and cryogen vapours are formed. As the dry snow sublimates, it absorbs heat at the rate of 246 British thermal units (Btu) per pound (for $CO_2$).

Cryogen injection is characterized by the ability to cause a fast thermal depletion. This is suitable for transporting frozen products that can sustain very low temperatures. In contrast, fresh or partially frozen products that can be damaged at very low temperatures cannot be safely transported in refrigerated vehicles of this type.

The crude oxygen injection system described above can be significantly refined by modulating the injectors to deliver in the cargo area liquid cryogen at a rate precisely controlled in accordance with the heat absorption requirements. This method, known as timed injection, achieves a much better temperature control and can be used to transport chilled products as long as they are not sensitive to excessive $CO_2$ concentration, or dryness. It should also be noted that cryogen liquid released in the cargo area has the effect of depleting the oxygen content of the refrigerated enclosure to a point where humans can no longer properly breathe and as a result, special loading procedures are required to limit the risks of respiratory injuries. For instance, the goods to be transported are always loaded in the cargo area without any pre-cooling so as to maintain the oxygen content at safe levels. Cryogen injection is effected only after the loading procedure has been completed and the cargo area sealed. It will become apparent that the exposure of the chilled or frozen products to ambient temperatures during the loading procedure is undesirable, particularly for products that are subject to quick deterioration or spoilage when exposed to ambient temperatures.

Cryogenic cooling systems that fall under the second category make use of an evaporator in which flows cryogen fluid prior to being dumped in the atmosphere. The cryogen gas undergoes a change in phase from liquid to gas in the evaporator, thus absorbing a large amount of heat in order to produce the desired cooling effect. The rate of temperature absorption is usually controlled by regulating the pressure in the evaporator. At lower pressure, the cryogen liquid evaporates at a rapid rate thus absorbing significant amounts of thermal energy. In contrast, an increase of pressure reduces the rate of cryogen evaporation for, in turn, diminishing the heat uptake by the system.

The thermodynamic activity taking place within the evaporator is not a continuous process because only a finite amount of liquid cryogen can be stored in the evaporator. When the cryogenic liquid is depleted, a refilling cycle must be carried out. This is accomplished by establishing a liquid path between the evaporator and a reserve vessel. Liquid cryogen is maintained in the reserve vessel under pressure (in the order of 300 pounds per square inch (psi)) and as a consequence, a natural transfer of fluid toward the empty evaporator occurs only if the pressure inside the evaporator is brought at a pressure lower than the pressure of the reserve vessel. Once the evaporator is filled with cryogenic liquid, the liquid communication with the reserve tank is terminated and the evaporator resumes its normal operation. During the evaporator refilling cycle, the heat absorption process required to maintain a constant temperature in the cargo area is severely affected because the operator has no control of the cryogen evaporation process which translates into undesirable temperature variations. When the heat absorption requirements are high, cryogen is consumed at an accelerated rate which shortens the time interval between refilling cycles. The resulting temperature disturbances may become significant enough to spoil sensitive products.

Although cryogen cooling system based on the evaporator technology can maintain a relatively stable temperature, they cannot effectively regulate the atmospheric water vapour content (relative humidity) in the cargo area. This quantity is an important factor in preventing fresh products from dehydrating. It is known that the temperature differential between the evaporator and the ambient temperature in the cargo area affects the humidity level. The higher the temperature differential the lower the relative humidity. Accordingly, quick cool down procedures that are usually performed with the evaporator operating at high temperature differential must be performed with great care to avoid desiccating sensitive products.

In conclusion, the cooling systems based on cryogen evaporation are far superior to traditional mechanical refrigeration units, yet they suffer from shortcomings that still need to be addressed for providing refrigerated vehicles that can truly provide optimum conditions for preserving delicate products from spoilage during long time periods.

OBJECTIVES AND SUMMARY OF THE INVENTION

An object of the invention is a cryogenic cooling system that is capable of maintaining a very stable temperature in an enclosure.

Another object of the invention is a cooling system capable of controlling the temperature in an enclosure without causing significant product desiccation.

Other objects of the invention will become apparent as the description proceeds.

As embodied and broadly described herein, the invention provides a system for cooling an enclosure, comprising:

an evaporator for receiving liquid cryogen (for the purpose of this specification "cryogen" designates a substance which when in the liquid phase boils at less than about −30° C. at atmospheric pressure, such as $CO_2$, hydrogen, helium, methane, nitrogen, oxygen, air, etc.) the liquid cryogen being capable of absorbing thermal energy in order to produce a cooling effect by undergoing a change of phase from liquid to gas in said evaporator;

an intermediary fill vessel in fluid communication with said evaporator for supplying liquid cryogen to said evaporator;

a reserve vessel in fluid communication with said intermediary fill vessel for supplying liquid cryogen to said intermediary fill vessel;

first valve means in a first fluid path established between said evaporator and said intermediary fill vessel, said first valve means being capable of selectively assuming an opened position and a closed position, in said opened position said first valve means allowing the transfer of cryogenic fluid between said intermediary fill vessel and said evaporator, in said closed position said first valve means terminating said fluid path;

a second valve means in a second fluid path established between said intermediary fill vessel and said reserve vessel, said second valve means being capable of selectively assuming an opened condition and a closed condition, in said opened condition said second valve means allowing the transfer of liquid cryogen from said reserve vessel toward said intermediary fill vessel, in said closed condition said second valve means terminating said second fluid path, whereby said first and second valve means allow to isolate said evaporator from said reserve vessel during:

a) transfer of liquid cryogen between said intermediary fill vessel and said reserve vessel; and b) transfer of liquid cryogen between said intermediary fill vessel and said evaporator.

In a preferred embodiment, the intermediary fill vessel communicates with the evaporator through a conduit incorporating a pump to transfer liquid cryogen from the intermediary fill vessel to the evaporator. During the normal operation of the system when the evaporator provides a heat absorption activity, the pump is continuously operated to replenish the liquid cryogen that is being gradually evaporated. A return line connects the evaporator back to the intermediary fill vessel to bring back the overflow of un-evaporated cryogenic liquid. Since this line also conveys a significant amount of gaseous cryogen, a gas-lined separator is incorporated in the return line path. The cryogen fluid is passed through the gas/liquid separator so only the liquid fraction of the fluid egressing the evaporator will be returned back to the tank. The gaseous fraction is vented at a controlled rate for regulating the pressure and temperature in the evaporator and, in turn, the rate of heat absorption by the cryogenic fluid.

When the intermediary fill vessel is depleted of liquid cryogen, a refilling cycle is initiated which consists of establishing a liquid communication between the intermediary fill vessel and a supply of liquid cryogen contained in a reserve vessel. During this refilling cycle, valves in the infeed line and in the gas/liquid return line between the evaporator and the intermediary fill vessel are closed, thus isolating the evaporator from the reserve vessel. When the refilling cycle is completed, the dual-line fluid communication between the intermediary fill vessel and the evaporator is re-established by opening the valves while the line connecting the reserve vessel to the intermediary fill vessel is closed.

It will become apparent that the intermediary fill vessel acts as a buffer that takes-up the pressure disturbances to the system occurring during the refilling cycle. As a result, the pressure in the evaporator can be better controlled, thus significantly reducing the temperature disturbances in the enclosure.

As embodied and broadly described, the invention also provides a system for cooling an enclosure, comprising:

a supply vessel for holding liquid cryogen;

an evaporator in fluid communicative relationship with said supply vessel for receiving liquid cryogen, said evaporator having a heat-acquisition surface through which thermal energy from the enclosure is being absorbed by the liquid cryogen undergoing a change of phase in said evaporator from liquid to gas in order to perform a cooling activity, said heat-acquisition surface having a selectively variable surface area, whereby allowing to control a rate of heat absorption by said evaporator.

Generally speaking, the temperature in the enclosure is controlled by regulating the amount the heat extracted from the enclosure per unit of time. Prior art cryogenic cooling systems based on the evaporator approach control the rate of heat transfer by varying the differential between the temperature of the evaporator and the temperature in the enclosure. In contrast, the cooling system in accordance with the invention provides an additional temperature control lever which is the surface area of the heat acquisition-surface. This feature enables to take-up heat at a fast rate and at a comparatively low temperature differential by using a larger heat-acquisition area. This leaves the temperature differential as a control lever for adjusting the rate of humidity depletion; the larger the temperature differential the faster water vapour is extracted from the air.

In a most preferred embodiment, the evaporator is made-up of modules that can be progressively put on line in order to expand the heat-acquisition surface. A fluid path links the evaporator modules to allow liquid cryogen to circulate through them. Inter-module valves control the flow of liquid cryogen so as to set the number of active modules at each given point in time during the operation of the system.

As embodied and broadly described herein, the invention further provides a cryogenic cooling system, comprising:

an evaporator for receiving liquid cryogen, the liquid cryogen being capable of absorbing thermal energy in order to produce a cooling effect by undergoing a change of phase from liquid to gas in said evaporator;

a supply vessel for holding liquid cryogen, said supply vessel being in fluid communication with said evaporator for supplying liquid cryogen to said evaporator;

a pump in a fluid path between said evaporator and said supply vessel for causing transfer of liquid cryogen from said supply vessel toward said evaporator;

a turbine in a driving relationship with said pump; and an exhaust conduit for supplying cryogen gas discharged from said evaporator to said turbine, thereby driving said turbine and causing said pump to operate.

The regenerative pump operated with working fluid discharged from the evaporator presents the advantage of transferring liquid from the supply vessel, such as the intermediary fill vessel to the evaporator without any external energy input. In addition, the pump throughoutput is automatically modulated according to the rate of cryogen consumption by the evaporator. When the evaporator is being operated near full capacity, the higher volume of cryogen gas that is being discharged drives the pump faster so as to transfer more liquid cryogen to the evaporator. In contrast, at a lower capacity of utilization, the cryogen feed rate by the pump is reduced since less working fluid is then available.

In a most preferred embodiment, the turbine is directly connected to the pump shaft so as to impart to it rotary mechanical power from the energy of the cryogenic gas exhaust stream. In a possible variant, the driving relationship between the turbine and the pump is established by the intermediary of a generator/electric motor system. More specifically, the turbine drives the generator to produce electrical energy that in turn is used for powering the electrical motor of the pump.

DESCRIPTION OF A PREFERRED EMBODIMENT

Figure 1:
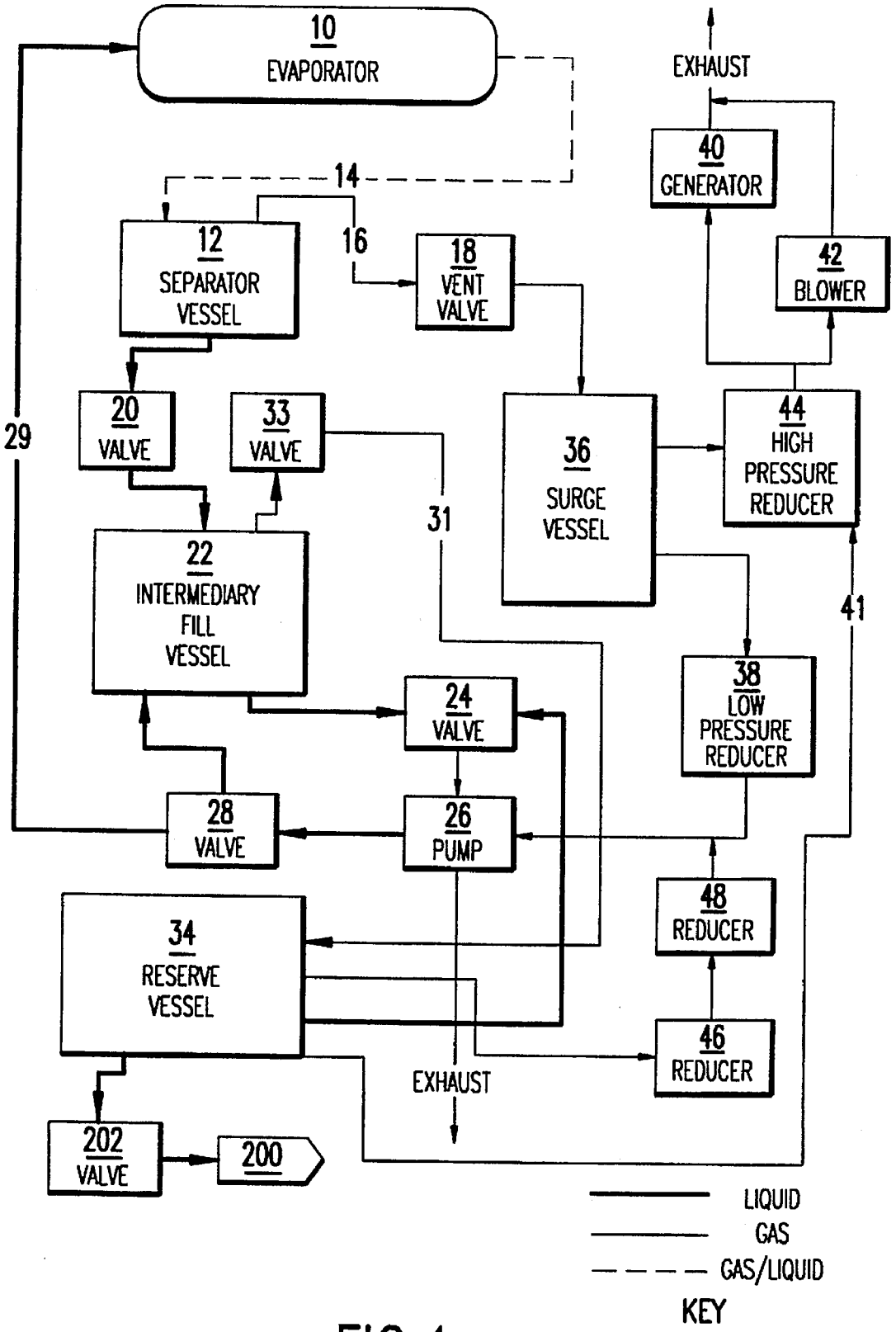
FIG. 1 is a flow chart of a cryogenic temperature control system constructed in accordance with the present invention.

The present invention provides a cryogenic cooling system that is particularly well-suited for transport vehicles such as refrigerated straight body trucks, trailers, railroad cars, ISO or domestic containers for intermodal transport, among others. With reference to FIG. 1, the cryogenic cooling system comprises an evaporator 10 that is designed to absorb thermal energy within the refrigerated enclosure in order to produce the desired cooling effect. In essence, liquid cryogen, such as $CO_2$ undergoes evaporation as a result of ambient heat. This change of phase from liquid to gas produces a thermal take-up. The cryogenic fluid is discharged from the evaporator through exhaust line 14 toward a separator vessel 12. The cryogenic fluid egressing the evaporator 10 includes a major gaseous fraction and a minor liquid fraction, i.e. unevaporated cryogen. The purpose of the separator vessel 12 is to divide these fractions under the effect of gravity. More particularly, the un-evaporated liquid flows down toward the bottom of the vessel while gas is directed through line 16 to a vent valve 18.

The liquid in the separator vessel 12 is returned to an intermediary fill vessel 22 under the effect of gravity through valve 20. The intermediary fill vessel 22 supplies liquid cryogen to the evaporator 10 through the fluid path comprising valve 24, pump 26 and valve 28 and finally infeed line 29. Valves 24 and 28 are three-way devices for controlling the flow of liquid cryogen from two different points. More particularly, in a first position, the valve 24 establishes a liquid communication between the intermediate fill vessel 22 and the pump 26. In a second mode of operation, cryogen liquid can flow from a reserve vessel 34 to pump 26 but, it is precluded to reaching the fill tank 22 through valve 24. Similarly, the valve 28, in a first mode of operation, enables liquid cryogen to pass from the pump 26 to the evaporator 10 through in-feed line 29. In a second mode of operation, in-feed line 29 is closed and the flow from the pump 26 is re-directed toward the intermediary fill tank 22.

The system of valves described above allows to selectively connect the intermediary fill vessel 22 with the reserve vessel 34 that constitutes the main supply of cryogenic liquid. This connection is established only when the intermediary fill vessel 22 is empty and needs to be refilled with cryogenic liquid. Between refill cycles, the cryogenic fluid flows from the intermediary fill vessel 22, through valve 24, pump 26, valve 28, the evaporator 10 and it is returned back to the intermediary fill vessel 22 through return line 14, separator 12 and valve 20.

The reserve vessel 34, the intermediary fill vessel 22, the separator vessel 12, and all the connecting lines are properly insulated to avoid unwanted evaporation of the liquid fluid.

During a refill cycle, the following valve action events are performed simultaneously:

a) valve 20 is closed to terminate the liquid path between the evaporator 10 and the intermediary fill vessel 22 on the cryogenic fluid return line;

b) valve 24 is switched to the second mode of operation so that the cryogenic liquid from the reserve tank 34 engross the pump 26;

c) valve 28 is switched to the second mode of operation, thereby closing the in-feed line 29 and allowing liquid cryogen discharged from the pump 26 to ingress the intermediary fill vessel 22; and d) a valve 33 is switched to open a de-gasing line 31 between the intermediary fill vessel 22 and the reserve vessel 34. The de-gasing line 31 opens within the reserve vessel 34 above the surface of the liquid body to allow the gaseous media in the intermediate fill vessel 22 to balance the pressure with the gaseous media inside the reserve vessel 34.

When the intermediary fill vessel has received a predetermined charge of liquid cryogen, the valves 24 and 28 are switched back to their original position so that the pump 26 directs the cryogen to the evaporator 10. Valve 33 is closed and valve 20 is opened to resume the normal operation of the evaporator 10.

During the refilling procedure, the fill vessel acts essentially as a buffer zone that precludes a direct communication between the reserve vessel 34 and the evaporator 10. It should be appreciated that the pressure in the reserve vessel 34 can be very different from the pressure in the evaporator 10. As a result, any direct communication between these components would significantly disturb the heat-absorbtion activity of the evaporator, and also place undue stress on the pump 26 since it could be subjected to a large pressure differential. In contrast, the intermediary fill vessel 22 allows to maintain a controlled level of pressure within the evaporator 10 during the refill cycle. Although cryogenic liquid is not supplied to the evaporator at this point, the heat up-take activity is maintained because at least some cryogen in liquid form remains in the evaporator and continues to convert to the gaseous phase.

The refill cycle is initiated by observing the level of cryogenic liquid within the intermediary fill vessel 22. This information is provided by a pair of level switches generating signals to notify the system controller when the level of cryogenic liquid has reached a high level or a low level. This feature will be described in detail later.

The gaseous fraction of the cryogenic fluid egressing the separator vessel 12 is directed toward a vent valve 18 that precisely regulates the rate at which gas is being released from the system for, in turn, controlling the pressure in the evaporator 10. Since there is a direct relation between the pressure in the evaporator 10 and the temperature of the cryogen, it is possible to adjust the heat up-take rate by controlling the evaporator pressure.

The gas released from the vent valve 18 is still at a considerable pressure and rather than dumping it in the atmosphere, the cooling system in accordance with the invention makes use of energy contained in the gaseous stream to energize components that are necessary for the operation of the system. More particularly, the vent valve discharges the gas released from the evaporator to a surge vessel 36 which stores the gaseous medium before it is used to drive the pump 26, a generator 40 and a blower 42. The pump 26 is always given priority because as discussed earlier, it plays an important role in transferring the liquid cryogen from the reserve vessel 34 to the intermediary fill tank 22 and for continuously supplying the evaporator 10. The hierarchy of the components supplied from the surge tank is determined on the basis of operating pressure. The pump 26 is supplied with low pressure gas from reducer 38 that opens at a pressure in the order of 20 pounds per square inch (PSI). The gas stream drives a turbine (not shown in the drawings) directly connected to the pump shaft to impart to it rotary movement. The exhaust gas from the turbine is directed through ducts (not shown in the drawings) under the floor of the enclosure, prior to being dumped in the atmosphere, so that whatever heat-absorption ability left in the gas is used to make a barrier to heat infiltration.

The turbines (not shown in the drawings) which activate the generator 40 and the blower 42 are supplied from a high pressure reducer 44 set at about 100 PSI. By this arrangement, the generator 40 and the blower 42 are allowed to operate only when the pressure in the surge vessel 36 has reached or exceeds 100 PSI. Below this level, the gas is reserved for the operation of the pump 26. The purpose of the generator 40 is to recharge the battery (not shown in the drawings) that supplies electrical energy to the electronic controls of the system; the generator 40 receives priority before the blower 42. The purpose of the blower is to create an air current inside the cargo area in order to eliminate hot spots. The blower can be beneficial for some perishable products that can warm-up during transport. The blower is a type described in the U.S. Pat. No. 4,986,086 issued on Jan. 22, 1991. The subject matter of this patent is incorporated herein by reference. Similar to the pump 26, the exhaust stream from the generator 40 and the blower 42 is conveyed through the ducts under the floor of the enclosure.

As mentioned previously, it is important that the transfer of liquid cryogen from the reserve vessel 34 to the intermediate fill vessel 22 be completed as quickly as possible because during the refilling cycle, the heat-absorbtion by the evaporator 10 can be limited. If the heat absorption is limited, only a educed amount of gas is discharged from the evaporator which may not be sufficient to actuate the pump 26, especially when the surge tank 36 has been previously depleted. For this reason, the cooling system in accordance with the invention provides a booster circuit that supplies cryogen gas directly from the reserve vessel 34 (assumed always to be under sufficient pressure). The booster circuit includes a reducer 46 which brings the pressure of the gaseous cryogen to about 110 PSI and a reducer 48 which further brings this pressure down to about 18 PSI and joins the line supplying working pressure to the pump 26. In this fashion, if no gas is available from the surge vessel 36, the gas coming from the reserve vessel 34 will drive the pump 26 during the liquid transfer cycle. However, if gas is available from the surge tank 36, it will take precedence at high pressure (20 PSI vs. 18 PSI). Accordingly, no gas will flow through the booster line.

Similarly, if the battery has a low voltage, the generator 40 is activated by the pressure of the reserve vessel 34 through line 41.

The cooling system in accordance with the invention also incorporates a pre-cooling section utilizing direct cryogen injection. A nozzle 200 directly supplied from the reserve vessel 34 releases in the enclosure a timed-spray of liquid cryogen. The flow of cryogen is controlled by a valve 202. The rapid cooling effect produced by evaporating/sublimating liquid cryogen is very effective for reducing the temperature of the structure of the enclosure, such as the walls, the floor and the ceiling, that has a significant thermal inertia. Without pre-cooling the evaporator 10 will require a longer time period to bring the temperature in the enclosure to the desired set point.

The nozzle 200 is also used as a cooling booster if the heat absorption capacity of evaporator 10 is insufficient for extreme temperature differential between inside and outside generators.

Figure 2:
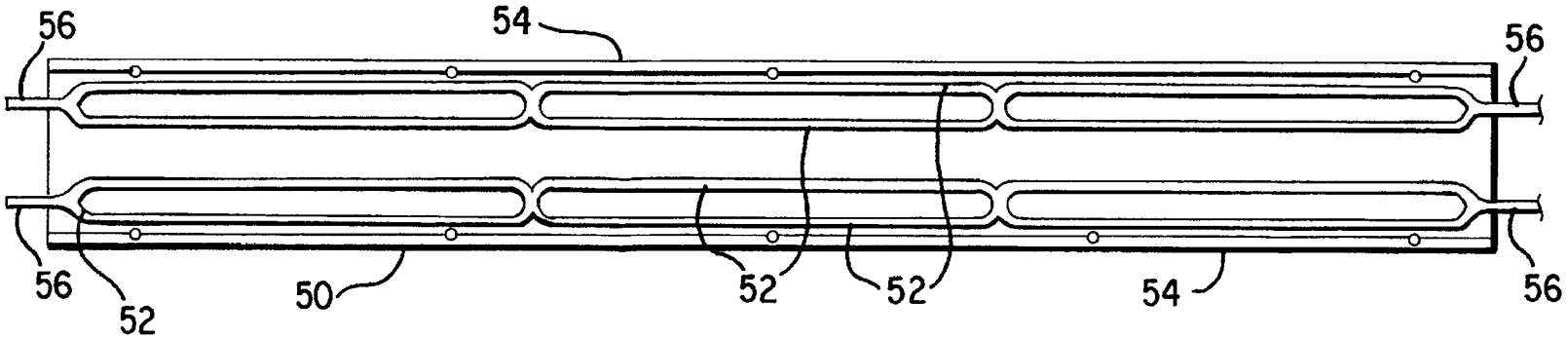
FIG. 2 is a plan view of an evaporator panel.

The structure of the evaporator 10 will now be described in detail in connection with FIGS. 2 to 7. The evaporator 10 is made of individual sections 50 that are assembled together in modules which can be selectively actuated to control the heat absorption rate of the evaporator. An evaporator section 50 is shown in FIG. 2. It is made of a solid sheet of aluminum having a thickness of 1.8 millimeters (mm) with a continuous tube circuit 52 being an integral part of the sheet and through which cryogenic fluid can pass. This plate-type heat exchange is manufactured by Algoods, a division of Alcan Aluminum Ltd. under the brand designation Roll-Bond. Each evaporator section 50 is eight feet long by one foot wide. The longitudinal extremities 54 of the evaporator section are downwardly folded for better rigidity. Four parallel tubes 52 extend in a parallel relationship lengthwise on the panel. At both ends of the section, the tubes merge into a pair of connector pipes 56 allowing to join several evaporator sections together.

Figure 4:
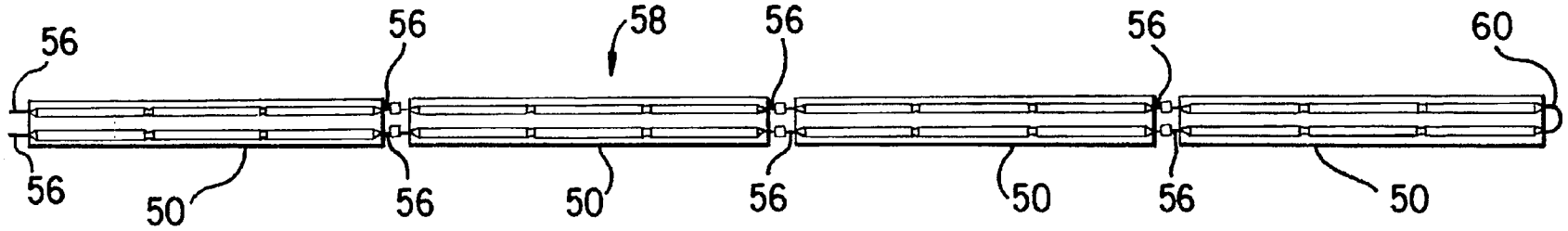
FIG. 4 illustrates a plurality of evaporator panels ganged together to form an evaporator module.

As shown in FIG. 4, several parallel sections 50 are serially joined together in a row to form an evaporator module 58. At one end of the row the connecting tubes 56 are joined at 60 to close the fluid circuit. Thus, one long double tube circuit is created. The liquid cryogen will exit right next to the point where it has entered the circuit after having absorbed the heat collected by the evaporator module.

Figure 3:
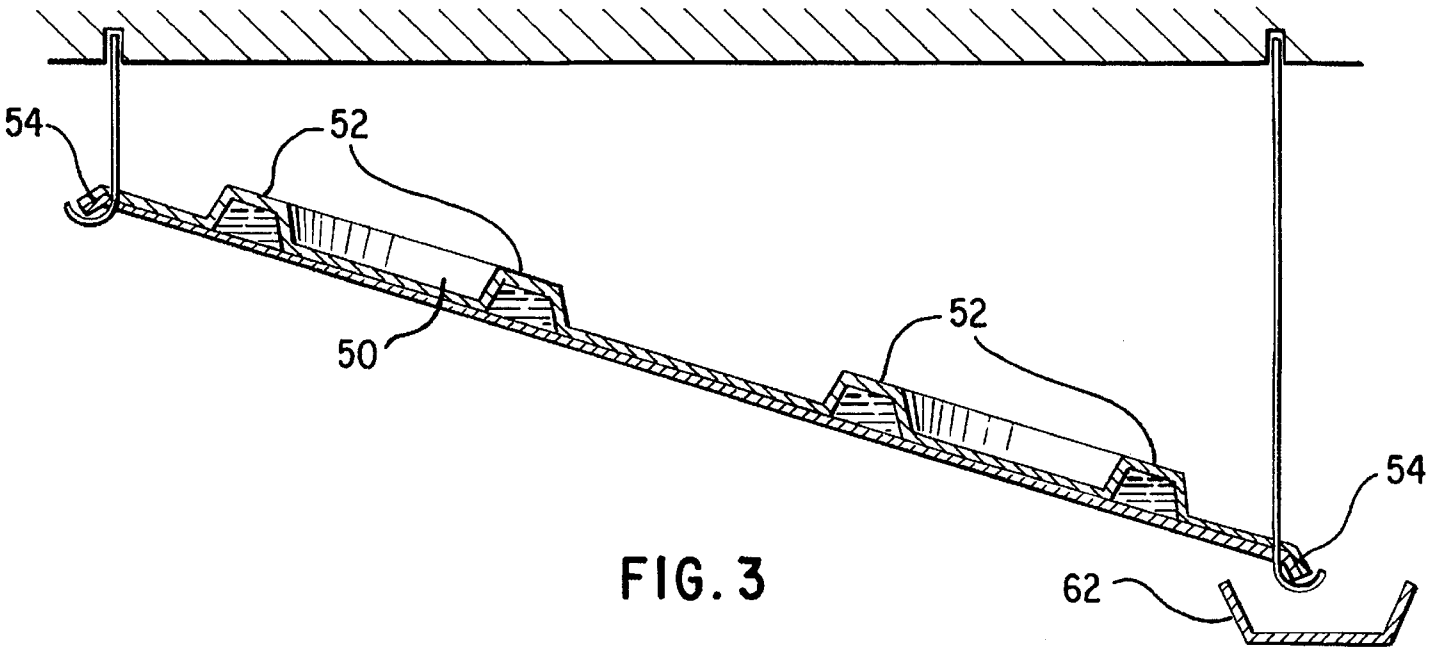
FIG. 3 is a vertical cross-sectional view of an evaporator panel shown connected to the ceiling structure of the refrigerated enclosure.
Figure 5:
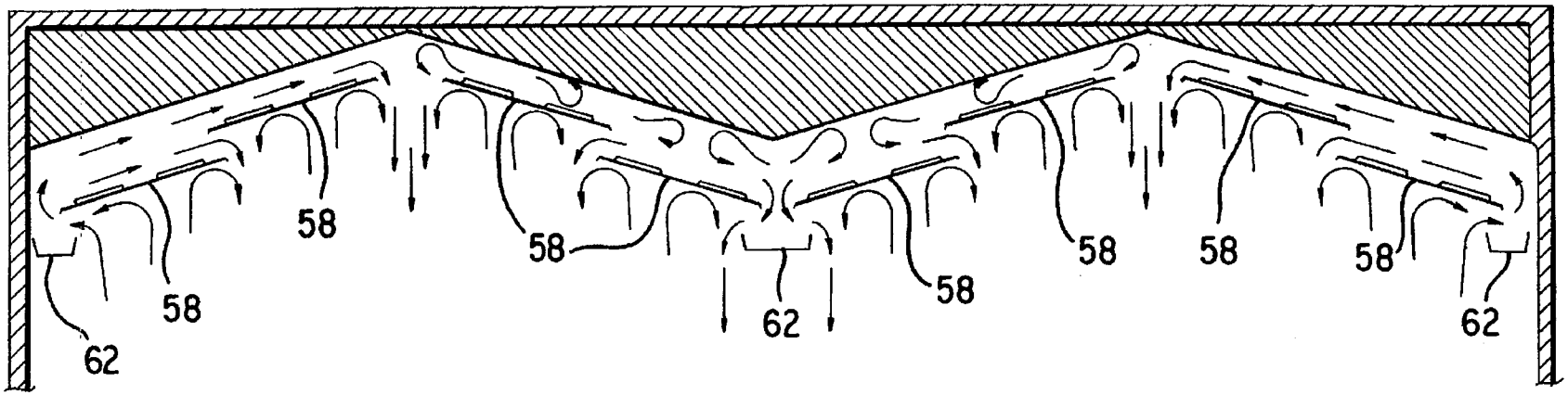
FIG. 5 is a vertical cross-sectional view of the refrigerated enclosure depicting the arrangement of evaporator modules, also showing with arrows the air currents passing between evaporator modules.

In one most preferred embodiment, eight such evaporator modules are hung from the roof of the enclosure. This feature is best shown in FIGS. 5 and 3. The evaporator modules are obliquely mounted, slightly overlapping each other so condensate liquid will slide downwardly and collect in the gutters 62, rather than dipping.

Figure 6A:
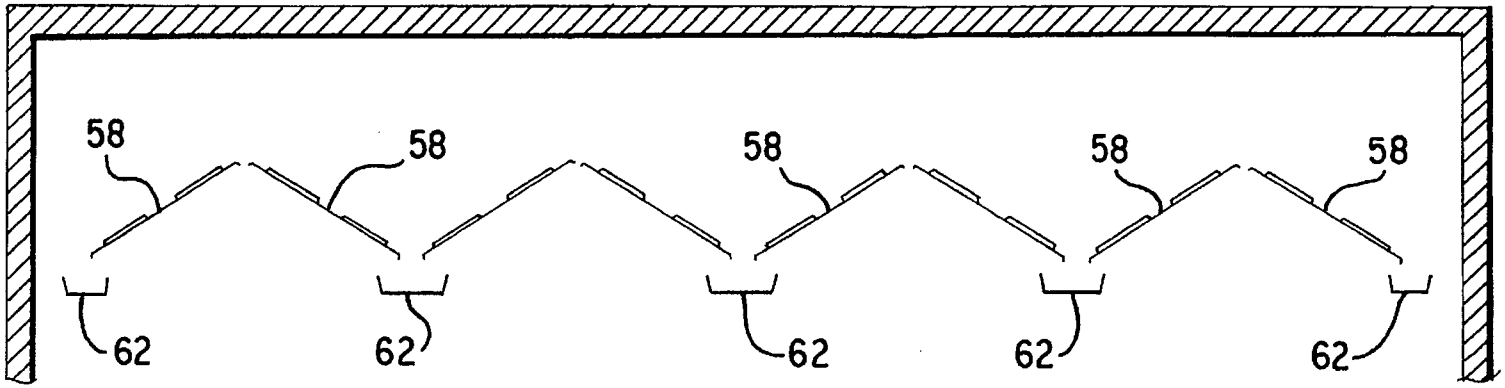
FIGS. 6*a* and 6*b* illustrate alternative arrangement of evaporator modules.
Figure 6B:
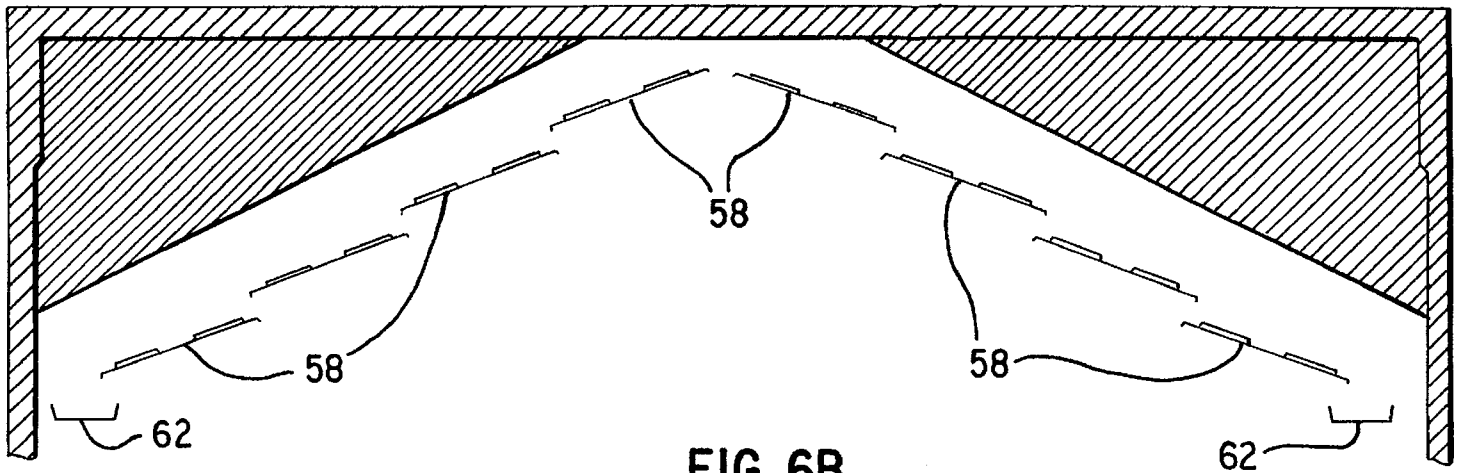

The positioning of the evaporator module as shown in FIG. 5 permits an excellent ascent of the heated air toward the evaporator along side walls of the enclosure. The hot air then travels above the modules 58 and is cooled by the evaporating cryogen liquid. The cold air then descends between the individual modules 58. In FIG. 5, the modules 58 extend along the longitudinal axis of the refrigerated enclosure. FIG. 6*a* shows a variant where the modules are in a multi-dome pattern and do not overlie one another. FIG. 6*b* is a further variant with overlaying modules arranged into a single dome configuration.

Figure 7:
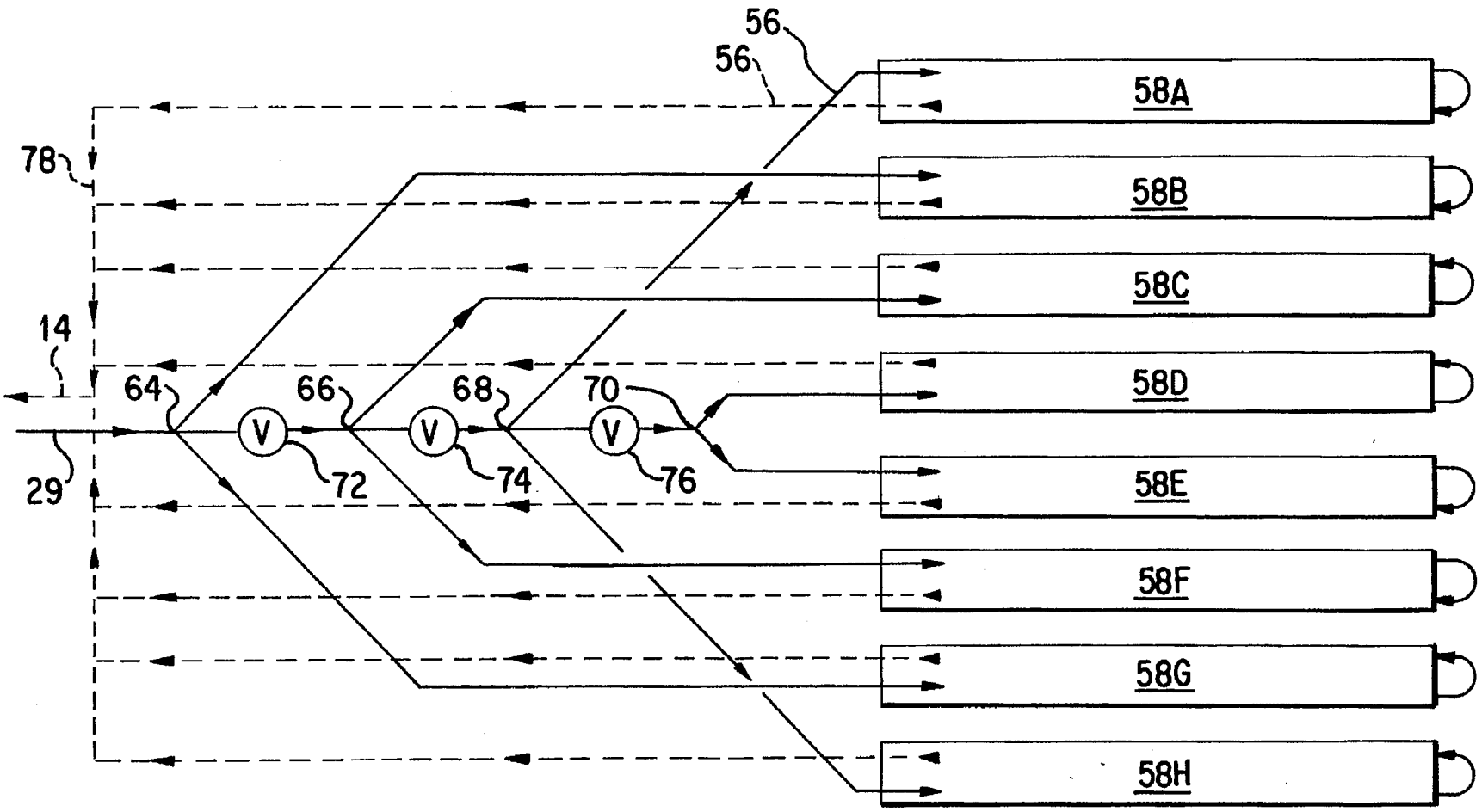
FIG. 7 is a schematical view of the evaporator manifolding illustrating the network of conduits and control valves that regulate the flow of cryogenic liquid to the individual evaporator modules.

FIG. 7 illustrates the manifolding arrangement of the evaporator module conduits and associated valving allowing to control the extent of the heat acquisition surface of the evaporator. In the drawing, eight evaporator modules are shown, designated by the reference numerals 58*a* to 58*h*. The liquid cryogen infeed line 29 connects with a first distribution node 64 that feeds modules 58*b* and 58*g*. Downstream the node 64 are provided three additional distribution nodes referred to by numerals 66, 68 and 70 that supply the evaporator module pairs 58*c* and 58*f*, 58*a* and 58*h* and 58*d* and 58*e*, respectively. Inter-node isolation valves 72, 74 and 76 control the flow of liquid cryogen to the various evaporator modules.

Figure 8:
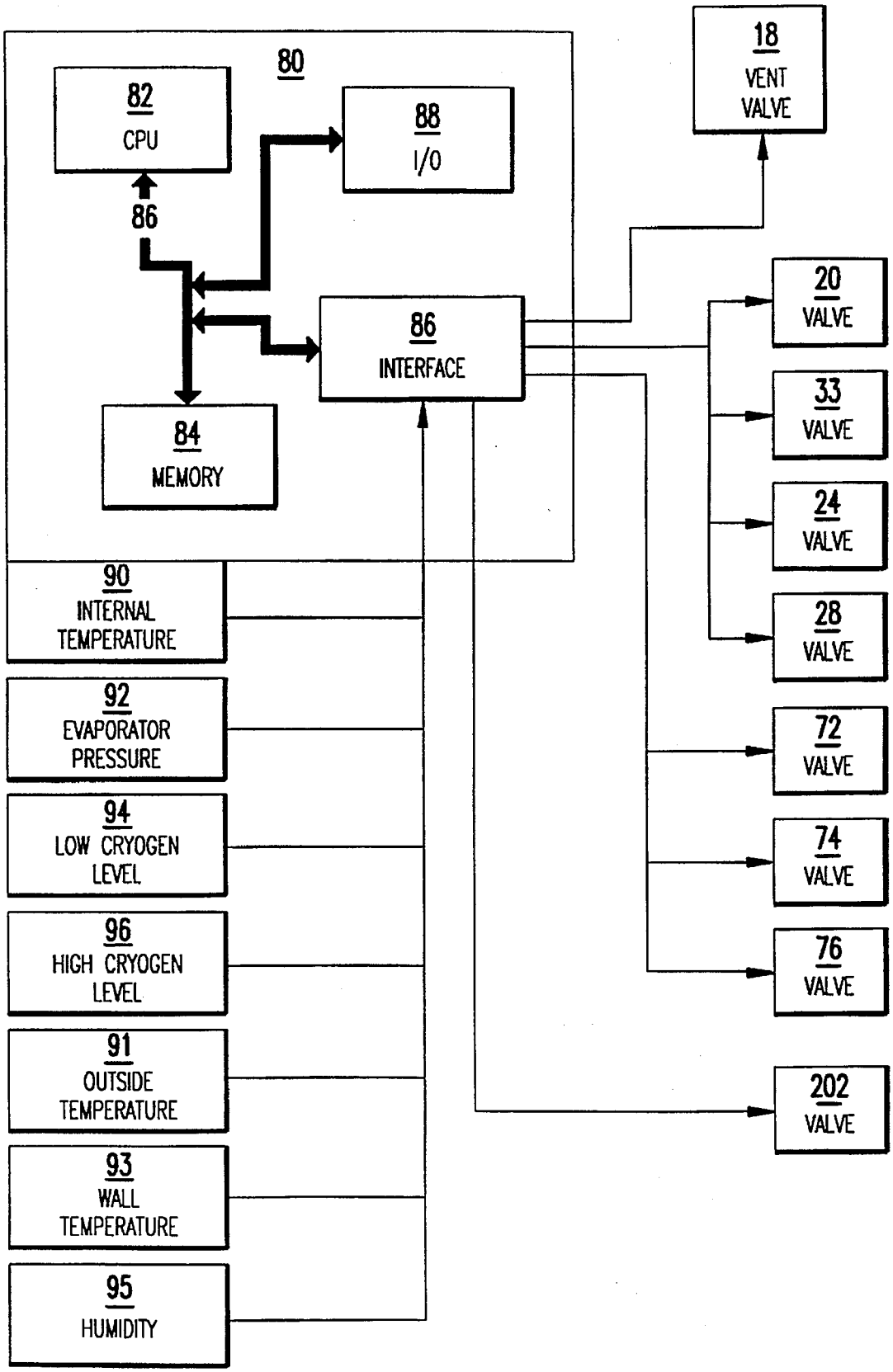
FIG. 8 is a block diagram of an electronic controller and the associated sensors for controlling the operation of the cryogenic cooling system.

FIG. 8 is a flow chart of the electronic controller that controls the operation of various system components for maintaining the temperature and the relative humidity as close as possible to a predetermined set point. The electronic controller 80 includes a central processing unit (CPU) 82 of known construction. A CPU available from Intel under the designation 80C5EFB has been found satisfactory. A memory 84 for the storage of data and program instructions communicates with the CPU 82 through a buss 86. A serial interface 86 enables the controller 80 to acquire data from various sensors and to output signals to the various components controlled by the system. Finally, the controller 80 also includes an input/output (I/O) unit 88 including a keyboard and display to allow the operator to modify the settings of the system, monitor the program execution, etc.

Four sensors are provided to notify the controller 80 of the occurrence of various events and of the magnitude of certain physical quantities so that the appropriate action can be taken in order to maintain the environmental conditions in the enclosure as close as possible to the set point. An internal temperature sensor 90 measures the ambient temperature in the refrigerated enclosure. The information generated by the sensor is used by the controller 80 to calculate a differential between the temperature set point and the actual temperature in the enclosure. On the basis of the magnitude of this differential, the controller will readjust the settings of the system in order to reduce the temperature error as much as possible. An evaporator pressure sensor 92 observes the pressure in the evaporator 10. This data is used by the controller to determine the temperature of the cryogen and the rate of evaporation of liquid cryogen, hence the rate at which heat is absorbed from the enclosure. An outside temperature sensor 91 measures the external temperature. This information is used by the controller to set the initial heat absorption capacity of the evaporator 10. A wall temperature sensor 93 supplies information on the temperature of the structure forming the refrigerated enclosure. The signal generated by sensor 93 is used mostly to control the duration of the pre-cooling cycle, as it will be described later.

On the basis of the information generated by the sensors 90 to 93, the controller 80 generates an output signal to the valve vent 18 for regulating the pressure inside the evaporator. Most preferably, the valve 18 is pulse modulated to regulate with a high level of precision the amount of gas that is allowed to escape the evaporator. In short, the vent valve is opened repeatedly for very short time intervals. By adjusting the duration of those time intervals (pulse duration modulation) a very accurate pressure control can be made in the evaporator. In a variant, the valve may be maintained opened during intervals of constant time duration, but by varying the pulse rate, i.e. the number of valve openings per unit of time, the flow rate of gas allowed to escape the evaporator is regulated. A valve available from H. D. Baumann Assoc. Ltd. under the brand designation Baumann has been found satisfactory.

Low cryogen level and high cryogen level sensors 94, 96 mounted in the intermediate fill vessel 22 to provide information on the level of cryogen liquid stored in that vessel. The information generated by these sensors is used to control the refilling procedure, as it will be described hereinafter.

The interface 86 also generates output signals to valves 20, 33, 24, 28 to control the refill cycle of the intermediary fill vessel 22, as it will be described in detail later. The interface 86 also controls the valve 72, 74 and 76 of the evaporator 10 that determine the number of currently active evaporator modules.

FIGS. 9*a* to 9*d* provide a flow chart of the program controlling the operation of the cryogen cooling system. At initialization step 98, the program performs a certain number of basic operations such as resetting counters to start values, locating in memory the beginning address of the data acquisition block and loading interrupt vectors, among others. At step 100, the internal temperature set point (TSET) is acquired. This is achieved by waiting for a predetermined period of time that the operator inputs a value. Specifying a new TSET is done either through the keyboard of the I/O unit 88 or through the serial interface 86 using an external computer connected to the controller 80. If after a predetermined delay no new TSET is entered, the program will initialise itself by loading from memory the last TSET value that has been used. Similarly, the program initializes at step 102 the desired relative humidity level by waiting for an input and if no input occurs than the prior humidity value is used.

Before precooling, Step 400 initiates a processing thread (see FIG. 9*d*) to determine the initial evaporator configuration, i.e., the number of active module pairs. At step 402 the outside temperature (OTEM) is determined by observing the output of sensor 91. On the basis of the value of TSET and OTEM the program calculates the temperature differential TD and consults a look-up table to find the number of evaporator module pairs that should be set in operation. The contents of the look-up table are reproduce below:

| INITIAL NUMBER OF MODULES | |
|---|---|
| If TSET is above 28° F. and TD < 25° F. | 2 modules |
| If TSET is above 28° F. and 25° F. < TD < 40° F. | 4 modules |
| If TSET is above 28° F. and 40° F. < TD < 60° F. | 6 modules |
| If TSET is above 28° F. and TD > 60° F. | 8 modules |
| If TSET is 28° F. or below | 8 modules |

At step 406 the isolation valves 72,74, and 76 are operated to configure the evaporator 10 according to the number of modules selected from the look-up table.

The program execution then jumps to step 104 where the controller 80 determines the maximum range within which the pressure may fluctuate in the evaporator 10 to help maintain the humidity at the set level. This calculation is done by:

a) reading the humidity level selected at step 102 (HH,MH, LH or frozen)* b) comparing the current humidity level with the set point; and c) consulting a look-up table stored in memory 84 to determine the boundaries of the pressure range according to the humidity level desired.

The boundaries of the pressure range are defined by the variables (PMAX and PMIN) that are at +/−X PSI from a median value PSET established on the basis of TSET. The magnitude of the variable X is inversely proportional to the humidity error value. The content of the look-up table reads for fresh products:

PMIN−25 and PMAX+25 for HH or high humidity.

PMIN−50 and PMAX+25 for MH or medium humidity.

PMIN−75 and PMAX+75 for LH or low humidity and frozen products.

It is important to note that the cooling system does not perform an active humidity control function; it merely controls the rate at which water vapour is extracted from the air or from the products (turning into frost and condensate on the evaporator). In other words, no water vapour input is made to raise the humidity level and the only action the system can take is to limit the amount of water vapour condensing on the evaporator so as to reduce as much as possible excessive desiccation.

An example can help to illustrate this point. Assume that products that do not release any humidity are loaded in the refrigerated enclosure that is at 75% relative humidity. If the operator sets the humidity setting at HH the system will not be able to reduce the humidity error value beyond the original 20%. However, by controlling the temperature differential between the evaporator and the temperature in the enclosure, the system can prevent the error value from increasing further. When the level of humidity desired is very high, the evaporator will be operated within a more restricted pressure range so as to limit the temperature deferential evaporator/enclosure. As previously mentioned, a high temperature differential increases the rate of water vapour condensation and frosting on the evaporator, thus causing a faster moisture depletion. In contrast, under a reduced temperature deferential conditions the withdrawal of moisture still occurs but at a much slower place. However, when the humidity error value is low, a higher operating pressure range is permissable.

The value of the variable PSET which is the median value at which the evaporator is originally set is determined on the basis of the temperature setting TSET. The following table is used for this purpose:

| Inside Temperature Set Point TSET in °F. | Initial Pressure Set Point Initial PSET in PSI | Equivalent Liquid $CO_2$ Temperature in °F. |
|---|---|---|
| 37 | 435 - Maximum Allowable | 24 |
| 36 | 430 | 23 |
| 34 | 420 | 22 |
| 32 | 410 | 21 |
| 28 | 390 | 18 |
| 24 | 370 | 14 |
| 20 | 350 | 11 |
| 16 | 330 | 7 |
| 12 | 310 | 4 |
| 8 | 290 | 0 |
| 4 | 270 | −4 |
| 0 | 250 | −8 |
| −4 | 230 | −13 |
| −8 | 210 | −17 |
| −10 | 200 - Minimum Allowable | −20 |

Figure 9A:
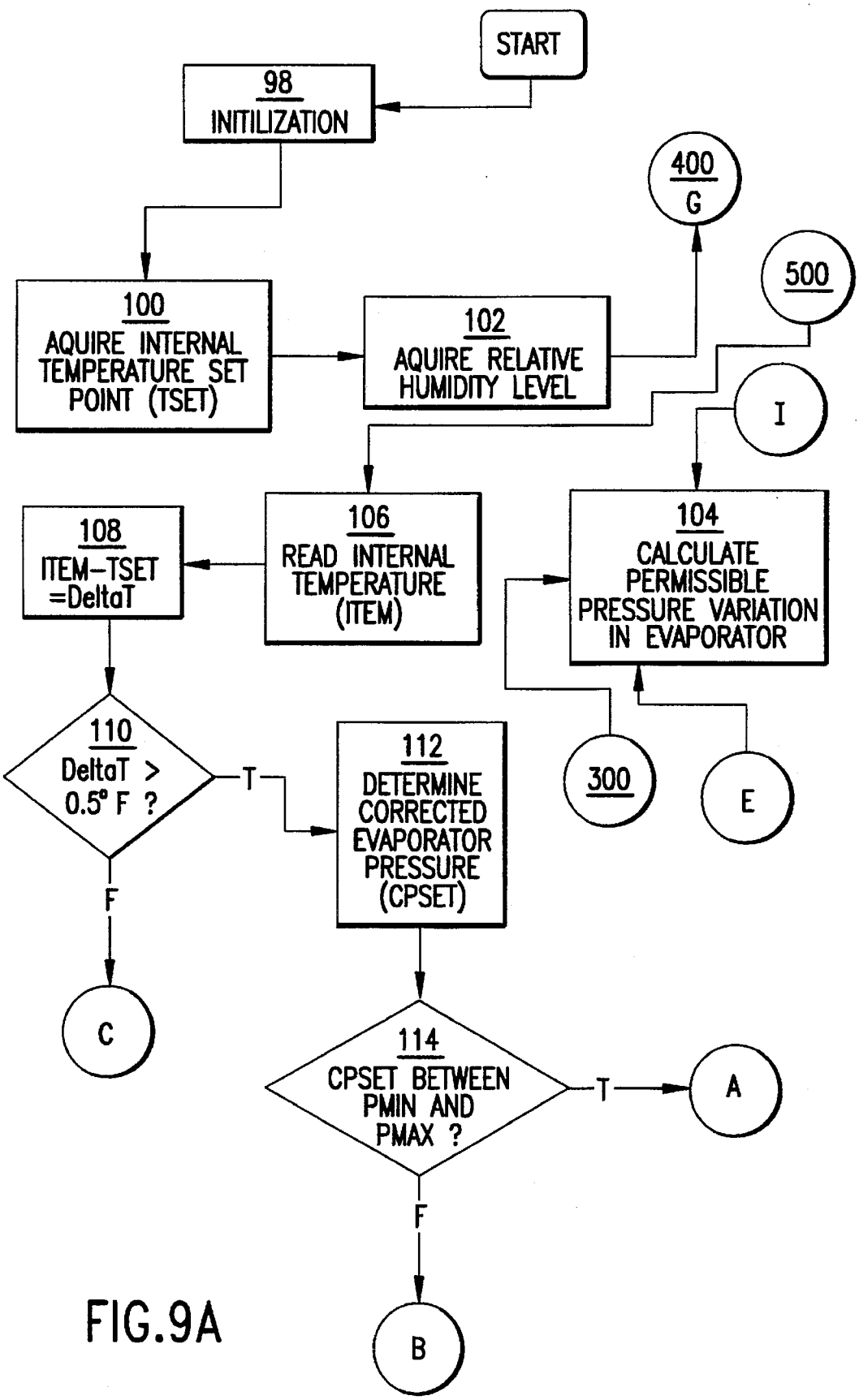
FIGS. 9*a* to 9*d* are flow charts of the program stored in the memory of the controller that is invoked for controlling the various functions of the cooling system.
Figure 9B:
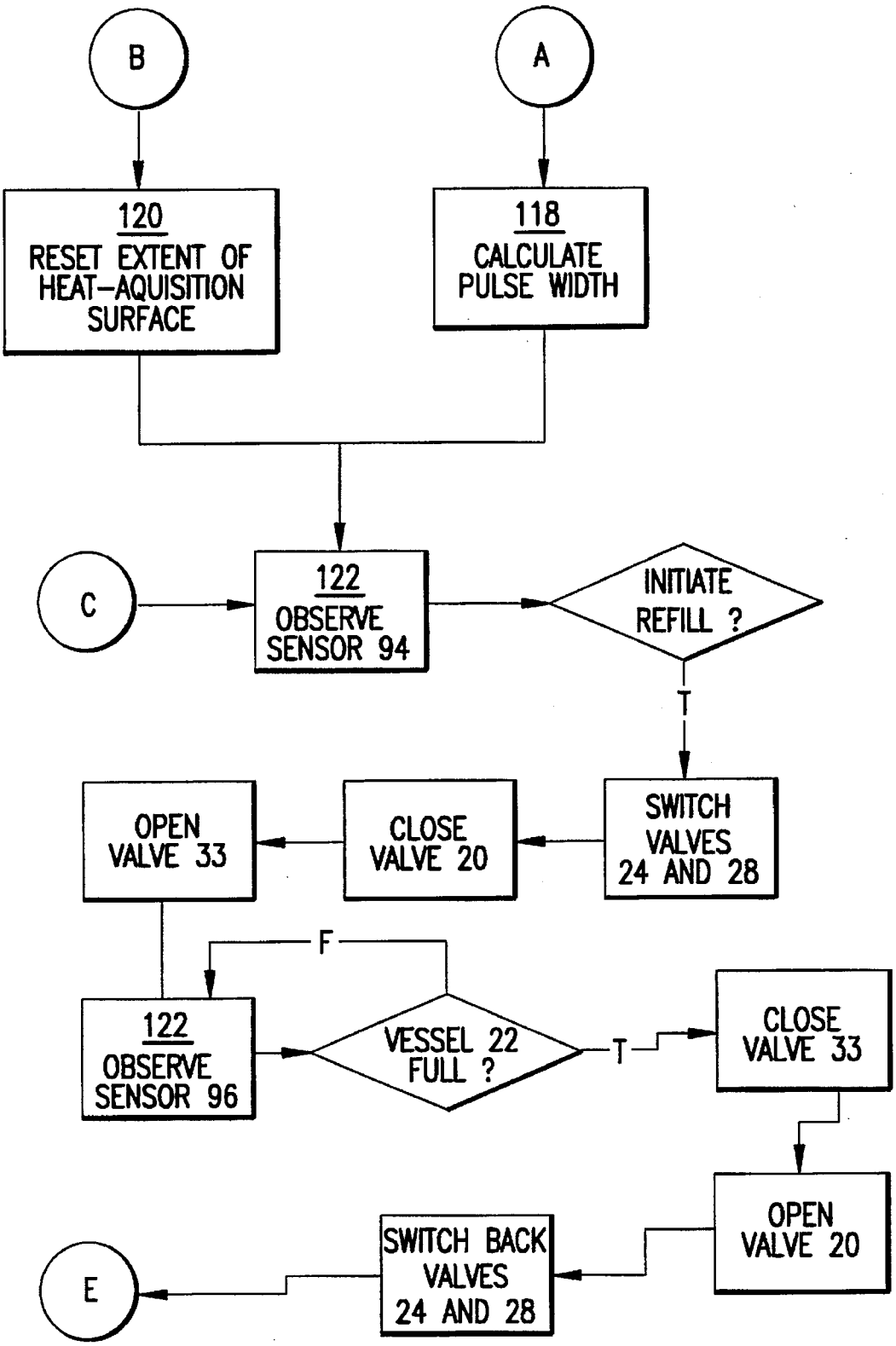
Figure 9C:
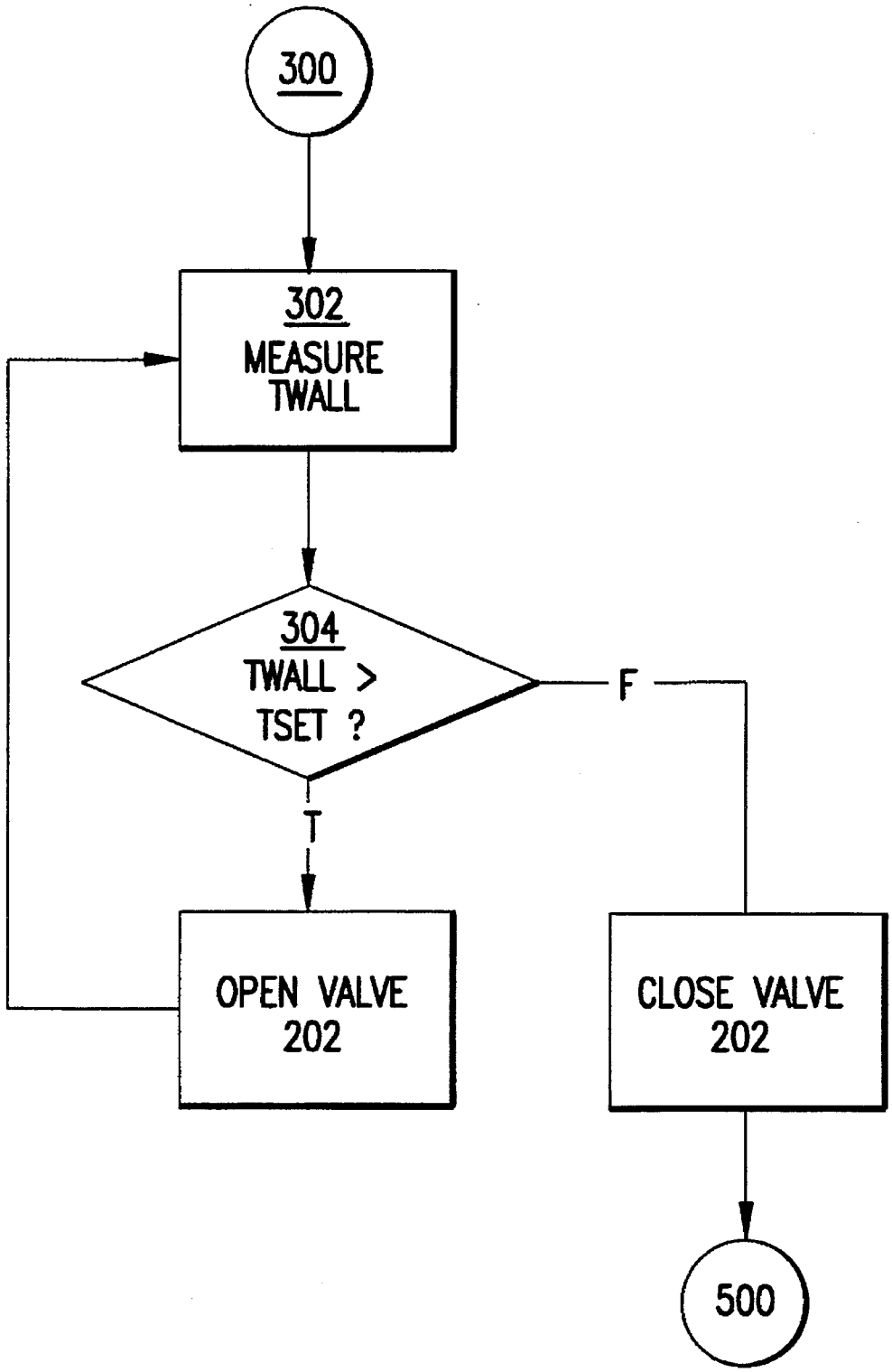
Figure 9D:
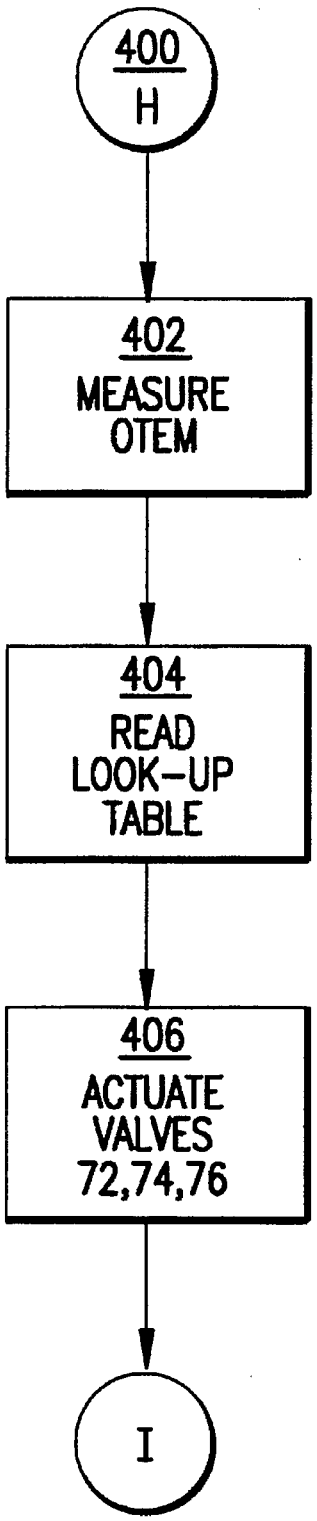
Figure 1:
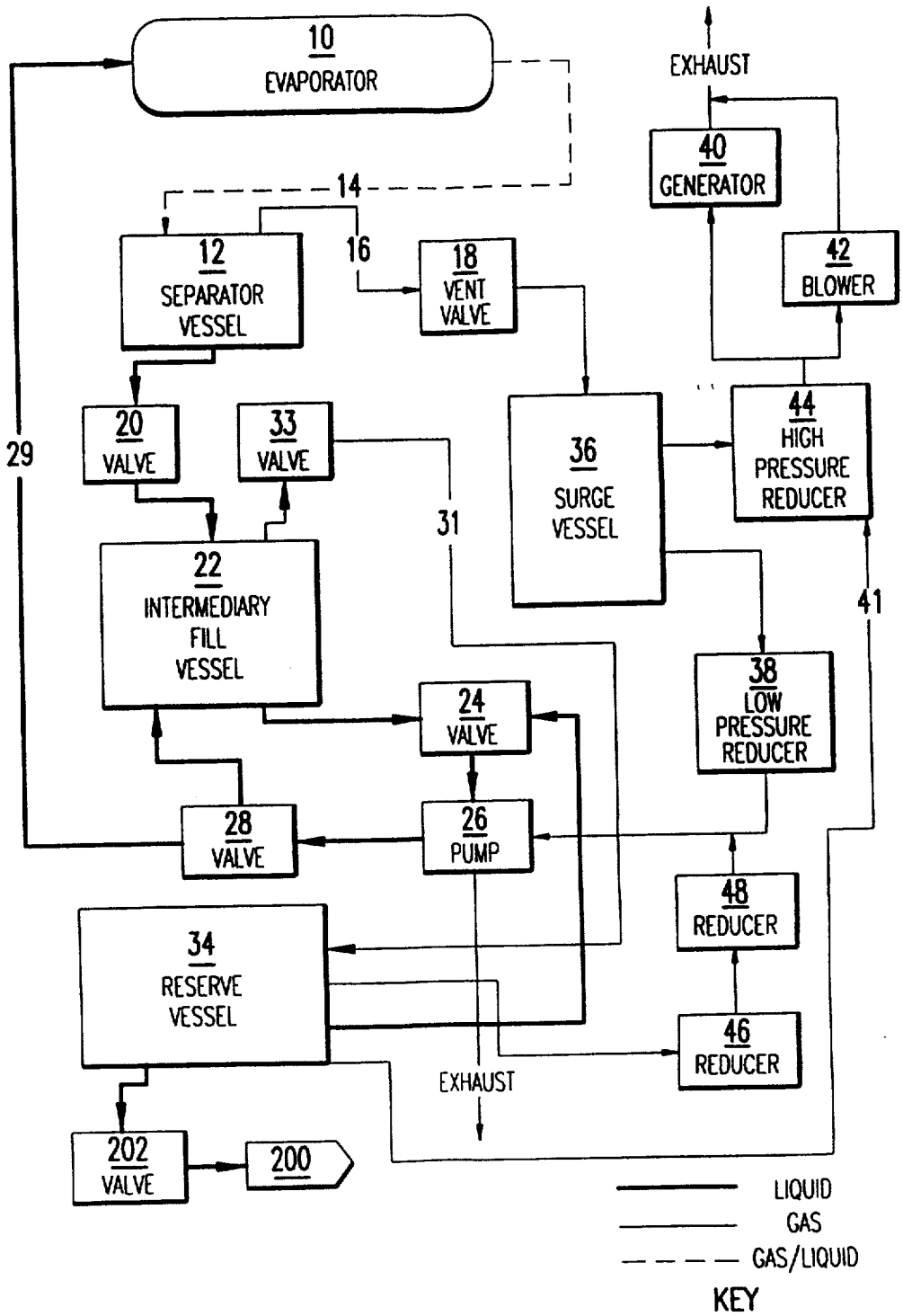

At step 300, the program initiates a pre-cooling procedure (see FIG. 9*c*). After observing at step 302 the wall temperature of the enclosure with sensor 93 (TWALL), a comparison is made with the set point (TSET). If TWALL>TSET the valve 202 is opened to spray liquid cryogen in the enclosure for 10 seconds ever 30 seconds. The temperature TWALL is repeatedly measure and the loop for opening and closing valve 202 is activated until TWALL is equal to TSET. Then it pursues with injection for 3 seconds every 30 seconds until the internal temperature observed by sensor 90 equals TSET. This terminates the pre-cooling procedure.

At step 106, a reading of the internal temperature (ITEM) is made by observing the signal produced by the sensor 90. ITEM is subtracted from TSET at step 108 to determine an error value (Delta) which is the differential between the temperature set point and the internal temperature of the enclosure.

At decision step 110 the magnitude of Delta is assessed. If it exceeds 0.5° F., the pressure in the evaporator is reduced in order to increase the heat take-up rate (when ITEM is smaller than TSET). When Delta is negative, i.e. TSET<ITEM by 0.5° F., the pressure in the evaporator is increased to reduce the rate at which the enclosure is being depleted of heat. The corrected pressure (CPSET) in the evaporator is determined by adding or subtracting, from the current pressure setting, as the case may be, N psi, where N is proportional to the temperature error and varies in the range from 3 psi to 20 psi. 5 psi variation corresponds to about 1° F. adjustment. The pressure correction is incremental from one program pass to another so the overall correction can extend way beyond the 20 psi limit for each step.

At decision step 114, the program determines if CPSET is between the specified range PMIN and PMAX established in accordance with the desired relative humidity level in the refrigerated enclosure. In the affirmative, the program calculates at step 118 a new pulse width according to which the vent valve 18 is to be operated in order to reach CPSET. Maximum pressure of 435 PSI and minimum pressure of 200 PSI are accepted by the program. Passed these pressure it is immediately considered as reaching a PMAX or a PMIN. On the other hand, if the CPSET is outside the range PMAX and PMIN, the program will open or close (depending upon the sign of the correction) one of the valves 72, 74 or 76 so as to increment or decrement by one the number of active evaporator module pairs. This action has the effect of expanding or reducing the heat-acquisition surface of the evaporator for, in turn, controlling the heat take-up rate while maintaining CPSET within the range of PMIN and PMAX.

Step 120 terminates the temperature control routine. The program then continues with a processing thread that controls the filling cycle of the intermediary fill vessel 22. More particularly, at step 122 a reading is made of sensor 94 to determine if the level of cryogenic liquid in the vessel 22 is at the level at which the refilling cycle must be initiated. If indeed the fill vessel 22 is low on cryogenic liquid, valves 24 and 28 are switched to establish a fluid path between the reserve vessel 34, the valve 24, the pump 26, the valve 28 and the intermediary fill vessel 22. In those valve positions, the in-feed line 29 is closed and the fluid path between the fill vessel 22 and the valve 24 is also closed. At the same time, valve 20 is closed and the de-gasing valve 33 is opened. As a result of this sequence of operation, the pump 26 draws liquid from the reserve vessel 34 and fills the intermediary fill vessel 22. At the same time, evaporator 10 is totally isolated from the remaining of the system so as to avoid disturbing the pressure therein.

At processing step 124, the program observes the output of sensor 96. That sensor will notify the controller 80 when the level of cryogenic liquid in the fill tank has reached an upper limit. If the vessel 22 is not filled yet, the program returns to step 124 to observe again the sensor 96. This loop is repeated until the vessel 22 is filled. At this point, the valve 33 is closed, the valve 20 is opened and the valves 24 and 28 are switched back to the original position thus establishing a communicative relationship between the intermediary fill vessel 22 and the evaporator 10.

The execution of the program then returns to step 106 to effect the new pass of the temperature control routine.

The valves used in the cryogenic cooling system described above are preferably gas driven electrically actuated devices. The advantage of those valves, is that they can be actuated by gaseous cryogen taken up at any suitable point in the circuit. What only is required is a weak electric current generated from the controller 80 to operate the valve. Those valves are well-known to the man skilled in the art and they do not need to be described in detail.

It can also be envisaged to provide the cooling system as described above with a small heating unit to supply heat when the outside temperature drops bellow the set point. A diesel heating unit has been found satisfactory. The heated air is preferably evenly distributed in the cargo area through ducts in the walls and the floor. It can also be envisaged to provide a thermopile generator (a component manufactured by Global Thermopile Canada, has been found satisfactory) to generate electricity from the thermal energy in the hot air stream. The electrical power is supplied to the controller 80 that may also be constructed to regulate the operation of the heating unit.

The cryogenic pre-cooling system as described above can also be conveniently used as booster to further cool down the enclosure when the heat-absorption requirements are high. The logic of the program in the control can recognize a situation when the evaporator is operating at full capacity, and then begins injection of cryogen in the enclosure if the temperature should be lowered. This booster function is suitable when transporting frozen products that are not susceptible to direct contact with cryogen liquid.

The present invention should not be interpreted in any limiting manners since refinements and variations are possible without departing from the spirit of the invention. The scope of the invention is defined in the appended claims and their technical equivalents.

We claim:

1. A cooling system for an insulated enclosure comprising:

a main insulated reserve vessel to store cryogen in liquid phase, in quantity sufficient to supply the cooling system with an appropriate fuel autonomy;

an evaporator thermally coupled to a ceiling of said enclosure, said evaporator containing cryogen in liquid and gaseous phases, wherein heat from said enclosure transferred to said evaporator by natural convection causing said cryogen in said evaporator to convert from said liquid to said gaseous phase thereby increasing the pressure inside said evaporator;

a vent valve means coupled to said evaporator, said vent valve means capable of releasing sufficient gaseous cryogen from said evaporator to maintain the pressure in said evaporator at a level required to insure adequate temperature of the cryogen and by so doing maintain said enclosure at a desired temperature;

a liquid transfer means which permits the transfer of the liquid cryogen from said main insulated reserve vessel to said evaporator as required and which provides liquid cryogen to said evaporator at a pressure level required to insure the proper temperature and heat absorption capability of said evaporator including an intermediate fill vessel in fluid communication with an input end of said evaporator to allow transfer of liquid cryogen therebetween, and further in fluid communication with separator vessel means at an exit end of said evaporator which ensures separation of cryogen in said liquid and gaseous phases and further in fluid communication with said main insulated reserve vessel which supplies liquid cryogen to said intermediate fill vessel;

a gas distribution means which disposes of gaseous cryogen evacuated from said evaporator through said vent valve means to activate various turbines which energize a liquid transfer pump, an electric generator and a fan blower, depending on the amount of gaseous cryogen available;

a direct cryogen injection means which is used for pre-cooling of said enclosure before loading, fast recooling after door opening, and cooling booster if heat absorption capacity of said evaporator module is insufficient;

an electronic controller with a program for commanding said vent valve means, said liquid transfer means, said gas distribution means and direct injection means, to operate as required, and for maintaining the appropriate pressure inside said evaporator and the various said means using data collected by temperature, pressure, humidity and $CO_2$ sensors, and sending signals to electronic solenoids activating pneumatic valves;

wherein said cooling system maintains said enclosure at temperatures as low as −20° F. and as high as +45° F. while the temperature outside said enclosure climbs as high as +120° F.;

wherein said cooling system maintains said enclosure at temperatures very close to a selected temperature;

wherein said cooling system modulates the heat absorption capability of said evaporator to obtain appropriate cooling with an appropriate level of humidity; and wherein said cooling system operates each claimed component without any outside source of energy other than the energy contained inside said gas cryogen.

2. A cooling system as defined in claim 1, wherein said evaporator further comprises:

a plurality of evaporator modules for receiving liquid cryogen into a piping network imbedded inside aluminum plates interconnected together; and a separator vessel means at an exit end of said evaporator to ensure separation of the cryogen in said liquid and gaseous phases, wherein said evaporator modules are manufactured in the form of panels positioned in a partially overlapping relationship and are obliquely arranged to allow drainage of condensates toward predetermined areas of said enclosure.

3. A cooling system as defined in claim 2, wherein each of said evaporator modules is equipped with an isolation valve for controlling the supply of liquid cryogen to individual evaporator modules, wherein control means regulate the operation of each of said isolation valves to permit a selected number of said evaporator modules to receive liquid cryogen and by so doing increase or decrease the heat absorption capability of said evaporator while maintaining the appropriate temperature differential between the temperature of said evaporator module and the temperature of said enclosure to control the humidity level of a product being transported in said enclosure.

4. A cooling system as defined in claim 1, wherein said liquid transfer means comprises:

a first valve means in a fluid path between said intermediate fill vessel and said evaporator to control flow of liquid cryogen between said evaporator and said intermediate fill vessel;

a second valve means in a fluid path between said main insulated reserve vessel and said intermediate fill vessel to control the transfer of liquid cryogen therebetween;

a third valve means in a fluid path between said separator vessel and said intermediate fill vessel to control the flow of liquid cryogen between said separator vessel and said intermediate fill vessel; and a fourth valve means in a fluid path between said intermediate fill vessel and a gas side of said main insulated reserve vessel to equalize the pressure of the cryogen in gaseous phase while said main insulated reserve vessel supplies liquid cryogen to said intermediate fill vessel;

wherein said electronic controller:

a) maintains said first valve means in an open condition when said intermediate fill vessel supplies liquid cryogen to said evaporator;

b) maintains said second valve means and said fourth valve means in a closed condition to preclude a fluid communicative relationship between said main insulated reserve vessel and said intermediate fill vessel when said intermediate fill vessel supplies liquid cryogen to said evaporator, thereby maintaining said main insulated reserve vessel isolated from said evaporator during the heat absorption process;

c) maintains said third valve means in an open condition when said fourth valve means is in a closed position, thereby maintaining said separator vessel in communication with said intermediate fill vessel during the heat absorption process to allow the overflow of cryogen liquid to return to the intermediate fill vessel; and d) maintains said first and third valves means in a closed condition when said second and fourth valve means are in an open condition, thereby isolating said evaporator and said separator vessel when said intermediate fill vessel is being replenished with liquid cryogen from said main insulated reserve vessel.

5. A cooling system as defined in claim 1 wherein said liquid transfer means comprises:

a first three way valve means for establishing a fluid path between said intermediate fill vessel and said evaporator while closing a fluid path between said intermediate fill vessel and said insulated reserve vessel and vice-versa;

a second three way valve means for establishing a fluid path between said main insulated reserve vessel and said intermediate fill vessel while closing a fluid path between said intermediate fill vessel and said evaporator, and vice-versa;

a third valve means in a fluid path between said separator vessel and said intermediate fill vessel to control the flow of liquid cryogen between said separator vessel and said intermediate fill vessel; and a fourth valve means in a fluid path between said intermediate fill vessel and a gas side of said main insulated reserve vessel to equalize the pressure of the cryogen in gaseous phase while said main insulated reserve vessel supplies liquid cryogen to said intermediate fill vessel;

wherein said third and fourth valve means are connected together so that, when said third valve means is opened, it automatically closes said fourth valve means, and vice-versa.

6. A cooling system as defined in claim 5, further comprising:

a gas driven pump in a fluid path between said first three way valve means and said second three way valve means to transfer liquid cryogen from either said intermediate fill vessel to said evaporator or from said main insulated reserve vessel to said intermediate fill vessel depending how said electronic controller opens or closes said first and second three way valve means and said third and fourth valve means; and two liquid level detector means comprising maximum and minimum level switches mounted inside said intermediate fill vessel to provide the required signals to said electronic controller for causing switching of the various valve means;

wherein said liquid transfer means provides to said evaporator a steady flow of liquid cryogen circulating at the precise pressure level required to insure the proper heat absorption capability to said evaporator, regardless of the pressure in said main liquid cryogen reserve vessel, and permits transfer of liquid from said main insulated reserve vessel to said evaporator as required, regardless of the pressure in said evaporator.

7. A cooling system as defined in claim 1, wherein said gas distribution means comprises:

a surge tank which receives the totality of the gas cryogen passing through said vent valve means, said surge tank being equipped with a safety valve set at approximately 175 PSI;

a by-pass poppet valve means in a fluid path between said surge tank and a turbine of said liquid transfer pump using gas cryogen reduced to approximately 20 PSI;

a back pressure regulator means and a generator spool valve means in a fluid path between said surge tank and a turbine of said electric generator using gas cryogen escaping from said surge tank when pressure rises above approximately 100 PSI; and a second back-pressure regulator means in a fluid path between said surge tank and a turbine of said fan blower using gas cryogen escaping from said surge tank when pressure rises above approximately 150 PSI;

wherein a plurality of cavities under a floor of said enclosure collect all of the exhaust gas from said turbines before it is released to the atmosphere and acts as a cold barrier to heat infiltration coming from under said enclosure;

wherein said gas distribution means supplies working fluid in the form of gaseous cryogen to said turbines without making use of pressurized gaseous cryogen stored inside said main insulated reserve vessel; and wherein said gas distribution means can introduce $CO_2$ gas inside said enclosure whenever instructed by said electronic controller to maintain proper concentration of $CO_2$.

8. A cooling system as defined in claim 7, further comprising a booster means for said gas distribution means whenever insufficient gas cryogen is generated by heat absorption of said evaporator, said booster means comprising:

a fluid path reduced to approximately 110 PSI connected to a gas side of said main insulated reserve vessel;

a pre-fill poppet valve means in said fluid path reduced to approximately 110 PSI coming from said insulated reserve vessel and further reduced to approximately 18 PSI, wherein said pre-fill poppet valve means supplies gas cryogen to said turbine of said liquid transfer pump if insufficient gas is available to said turbine from said surge tank to operate according to the program of said electronic controller; and a valve means in said fluid path reduced to approximately 110 PSI coming from said main insulated reserve vessel and opening communication with said generator spool valve means which supply said turbine of said electric generator or said turbine of said fan blower, if the electronic controller specifically requests it.

9. A cooling system as defined in claim 1, further comprising a valve means for pre-cooling said enclosure by directly injecting liquid cryogen in to said enclosure concurrently to said heat absorption generated by said evaporator, wherein said valve means is disposed in a fluid path between said main insulated reserve vessel and said enclosure, and is opened and closed by said electronic controller in response to said temperature set point established by said operator, whereby the temperature inside said enclosure is quickly reduced to the temperature set point before perishable products are introduced inside said enclosure;

whereby said valve means progressively establishes the temperature inside said enclosure to said temperature set point by short injections of liquid cryogen as required; and wherein said system is then operated in normal operation mode whereby said electronic controller adjusts the pressure set point of said vent valve means and the opening and closing of said isolation valves inside precise limits to maintain the proper temperature and humidity levels without further injection of liquid cryogen.

10. A cooling system as defined in claim 9, further comprising:

a switch means for activating said electronic controller after closure of doors of said enclosure to insure quick recovery of the temperature of said enclosure by timed injections of SAID liquid cryogen by said valve means until said set of temperature is reached again inside said enclosure;

wherein said switch means is operated automatically when said doors are closed;

wherein when said doors are open, said switch means stops any possible injection of liquid cryogen inside said enclosure so that personnel loading said enclosure are not incommodated during loading of said enclosure; and where in said switch means temporarily stops any adjustment in pressure or temperature or said enclosure until after said doors are closed.

11. A cooling system as defined in claim 9, wherein said electronic controller activates said valve means to respond to the demands of said $CO_2$ sensor, whereby the timed opening and closing of said valve means occurs for approximately 1½ seconds every 30 seconds until the proper concentration is reached; and wherein when said valve means is set at 0° concentration, said valve means will not open after said enclosure has been pre-cooled even after said doors are opened.

12. A cooling system as defined in claim 9, wherein said electronic controller activates said valve means as a booster when the temperature of said cryogen inside said evaporator cannot be reduced to a temperature low enough to absorb the totality of the heat absorption requirement of said system when products transported in said enclosure are frozen or sub-frozen and the temperature outside said enclosure is extremely high.

13. A cooling system as defined in claim 1, further comprising:

a heater to permit the transportation of perishable products when the temperature outside said enclosure is lower then the temperature set point selected for said enclosure;

wherein said heater circulates glycol inside a piping enclosed under a floor of said enclosure or at the base of the walls of said enclosure; and wherein said heater is equipped with a thermopile which produces enough electricity to operate a circulating pump and glow plug of said heater and to recharge a battery and operate a small electric fan.

14. A cooling system as defined in claim 1, wherein said electronic controller further comprises:

a digital keyboard for inputting by said operator of said cooling system, the temperature set point, the level of humidity desired, and the concentration of $CO_2$ required, whereby said electronic controller determines the number of said isolation valves to be opened and the pressure to be maintained in said evaporator, and then monitors every action or reaction of the system to reflect the input by said operator.

15. A cooling system as defined in claim 1, wherein said main reserve vessel is located under a floor of said enclosure in a non-obstructive location permitting maximum loading of the vehicle.

16. A cooling system as defined in claim 1, where said main reserve vessel is remote to permit the supply of cryogen to several separate cooling systems.

* * * * *

UNITED STATES PATENT AND TRADEMARK OFFICE

CERTIFICATE OF CORRECTION

PATENT : 5,660,046

DATED : August 26, 1997

INVENTOR(S) : Bernard de Langavant et al

It is certified that error appears in the above-identified patent and that said Letters Patent is hereby corrected as shown below:

In the Drawings, Figure 1 should be deleted and substitute therefor the corrected Figure 1, as shown on the attached page.

Column 1, line 59, delete "oxygen" and substitute --cryogen-- therefor.

Column 7, line 41, delete "continuously" and substitute --intermittently-- therefor.

Column 8, line 10, delete "educed" and substitute --reduced-- therefor.

Column 12, line 33, delete "ITEM is subtracted from TSET" and substitute TSET is subtracted from ITEM-- therefor.

UNITED STATES PATENT AND TRADEMARK OFFICE

CERTIFICATE OF CORRECTION

PATENT : 5,660,046

DATED : August 26, 1997

INVENTOR(S) : Bernard de Langavant et al

It is certified that error appears in the above-identified patent and that said Letters Patent is hereby corrected as shown below:

Column 12, line 39, after "rate." insert --When Delta is negative--,
line 40, delete ". When Delta is negative, i.e." and insert --, and if exceeds 0.5° F,--, and line 41, delete "TSET<ITEM by 0.5° F.,".

Signed and Sealed this

Seventeenth Day of February, 1998

*Attest:*

*Attesting Officer*

BRUCE LEHMAN

*Commissioner of Patents and Trademarks*